US005848761A

United States Patent [19]

Reinhold

[11] Patent Number: 5,848,761

[45] Date of Patent: Dec. 15, 1998

[54] SLITTING AND TRANSPORTING ROLLER FOR SHEETS OF MATERIAL

[76] Inventor: Klaus Reinhold, Kroenerstrasse 3, 49525 Lengerich i.W., Germany

[21] Appl. No.: 506,701

[22] Filed: Jul. 25, 1995

[30] Foreign Application Priority Data

Aug. 17, 1994 [DE] Germany ..... 94 13 238 U

[51] Int. Cl.[6] ..... B65H 35/08

[52] U.S. Cl. ..... 242/527.1; 242/533.4

[58] Field of Search ..... 242/527.1, 527.5, 242/533.4

[56] References Cited

U.S. PATENT DOCUMENTS

| | | | |
|---|---|---|---|
| 4,056,918 | 11/1977 | Matsumoto | 242/527.1 |
| 5,226,611 | 7/1993 | Butterworth et al. | 242/527.1 |
| 5,288,033 | 2/1994 | Kirkpatrick | 242/527.5 |
| 5,713,534 | 2/1998 | McClenathan et al. | 242/527.1 |

FOREIGN PATENT DOCUMENTS

| | | | |
|---|---|---|---|
| 60-82557 | 5/1985 | Japan | 242/527.1 |
| 1021489 | 6/1983 | U.S.S.R. | 242/527.1 |

*Primary Examiner*—John P. Darling
*Attorney, Agent, or Firm*—Jordan and Hamburg

[57] ABSTRACT

A slitting and transporting roller of the described type for sheets of material is suitable particularly as a mating roller in an apparatus for winding up sheets of film, paper and similar materials coming in continuously. In the inner cavity of the roller, a separator is inserted, which forms with the periphery of the roller the boundary at least one pressure space which extends essentially axially over the whole axial length of the roller and is in contact over penetrating boreholes in the roller sheath with the surroundings. Outside of the region of the penetrating boreholes the periphery of the roller additionally is provided with a penetrating slot, which extends, in turn, essentially over the whole axial length of the roller, for a separating slitter supported in the inner cavity of the roller.

17 Claims, 6 Drawing Sheets

SLITTING AND TRANSPORTING ROLLER FOR SHEETS OF MATERIAL

BACKGROUND OF THE INVENTION

The invention relates to a slitting and transporting roller for sheets of materials, which finds use particularly as a mating roller in equipment for winding up sheets of film, paper and similar materials coming in continuously over guide rollers.

Numerous winders are known, which work with a mating roller and for which a separate cutter with a separating slitter, which severs the sheet of material when the winding up of the material on a particular winding shaft is completed, is provided as a roller changing unit. There are difficulties here with detaching the end of the sheet, which was severed from the winding roller, from the winding roller and fixing it rapidly and reliably, as the starting end of a new sheet, on a new winding shaft or a winding tube mounted thereon as roller core while the sheet of material is coming in continuously, without large losses of material and without producing undesirable folds in the sheet of material during the start of the winding process.

SUMMARY OF THE INVENTION

It is therefore an object of the invention to provide a slitting and transporting roller, which is suitable particularly as a mating roller for winders and with which rollers can be exchanged simply and quickly and, in particular, the new starting end of the sheet can be fixed positionally accurately and securely on the new winding shaft in order to avoid fold formation and sheet losses.

The slitting and transporting roller, constructed in this way and used in a winder, forms a mating roller with an integrated roller changing unit in such a manner, that the separating slitter forms a component of the mating roller itself and the severed end of the sheet can thus be transferred reliably over a short path as the new starting end of the sheet to a winding shaft for starting the winding process.

In particular, the roller changing unit comprises the separating slitter for severing the sheet of material when the winding of the winding roller is completed and the pressure chamber, which is effective at the periphery of the winding roller, for taking hold of the new starting end of the sheet and transferring it to a new winding shaft. For taking hold of the new starting end of the sheet by means of the pressure chamber, a vacuum can be applied to the periphery of the mating roller and, for transferring the starting end of the sheet to the new winding shaft, the periphery of the mating roller can be acted upon over the pressure chamber with an elevated pressure repelling the starting end of the sheet from the periphery of the roller. By these means, after the sheet of material is severed by means of the separating slitter, the new starting end of the sheet is at first held securely by the vacuum at the periphery of the mating roller, whereas, when the new winding shaft is reached, the new starting end of the sheet is repelled from the periphery of the mating roller and, at the same time, wound onto the new winding shaft or its winding tube by switching the pressure chamber over to pressure.

Numerous further distinguishing features and advantages of the invention arise out of the additional claims and the specification below in conjunction with the drawing, in which several embodiments of the inventive slitting and transporting rollers are illustrated diagrammatically.

DESCRIPTION OF THE PREFERRED EMBODIMENTS

Figure 1:
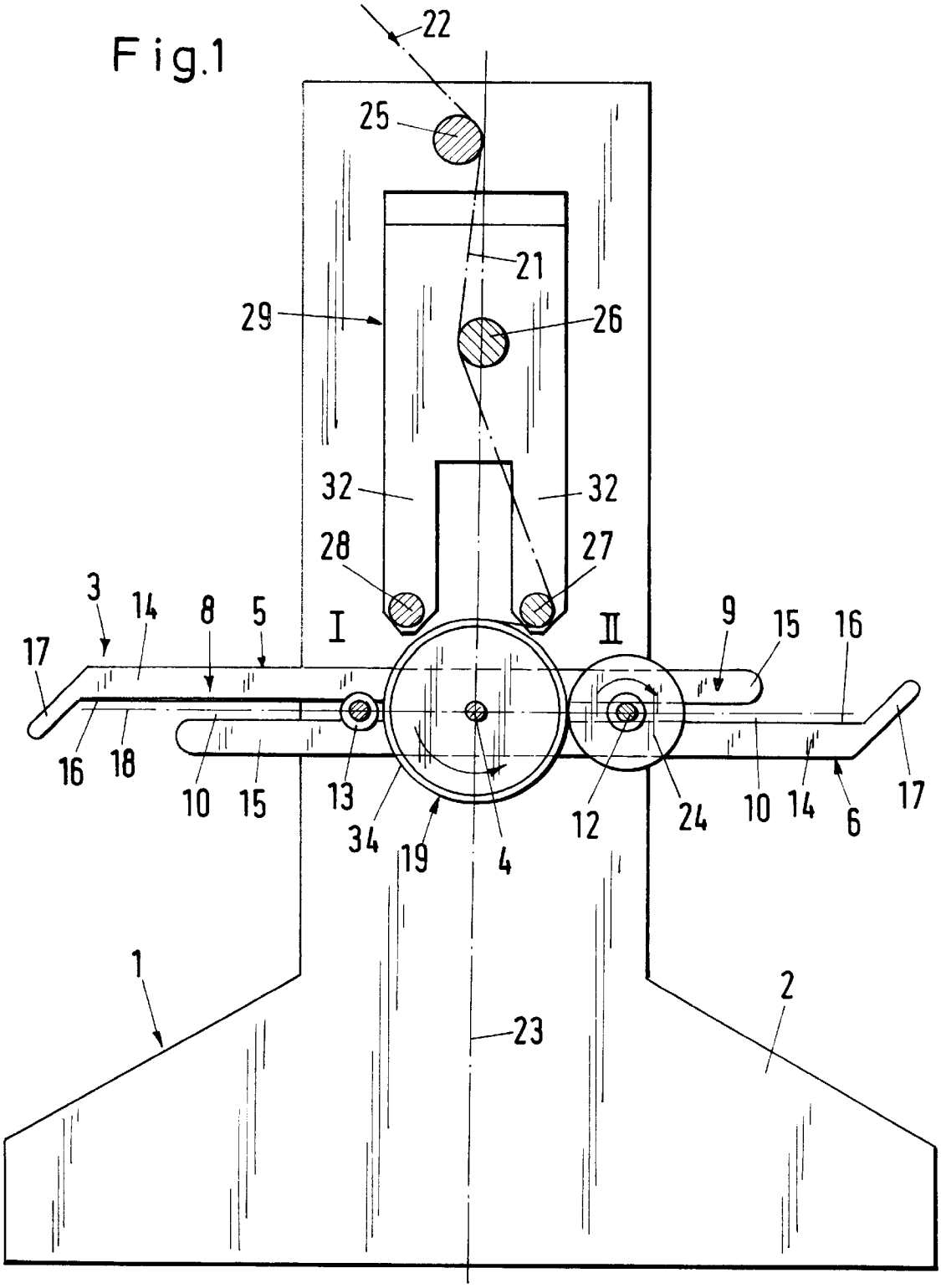
FIG. 1 shows a vertical, longitudinal section through a winder during a winding process, the sheet of material being wound clockwise.

The winder, shown in the drawing, serves for winding up sheets of material such as plastic film, which is produced continuously by an extruder and is wound up as a flat sheet.

In an apparatus frame, labeled 1 as a whole and having two opposite identical side walls 2, a drag bearing, which is labeled 3 as a whole, is supported so that it can pivot about a horizontal axis of rotation 4. The drag bearing 3 is formed from a double lever, the individual levers 5 and 6 of which, having identical contours, are each rotatably mounted in an adjoining side wall 2 of the apparatus frame 1 in bearings installed on the inside. The two individual levers 5 and 6 are in each case formed by a 2 arm lever, the two lever arms 8 and 9 of which, starting out from an internal region encompassing the axis of rotation 4, in each case are provided with a guide slot 10 for the respective shaft end of a winding shaft 12 or 13 respectively.

Figure 2:
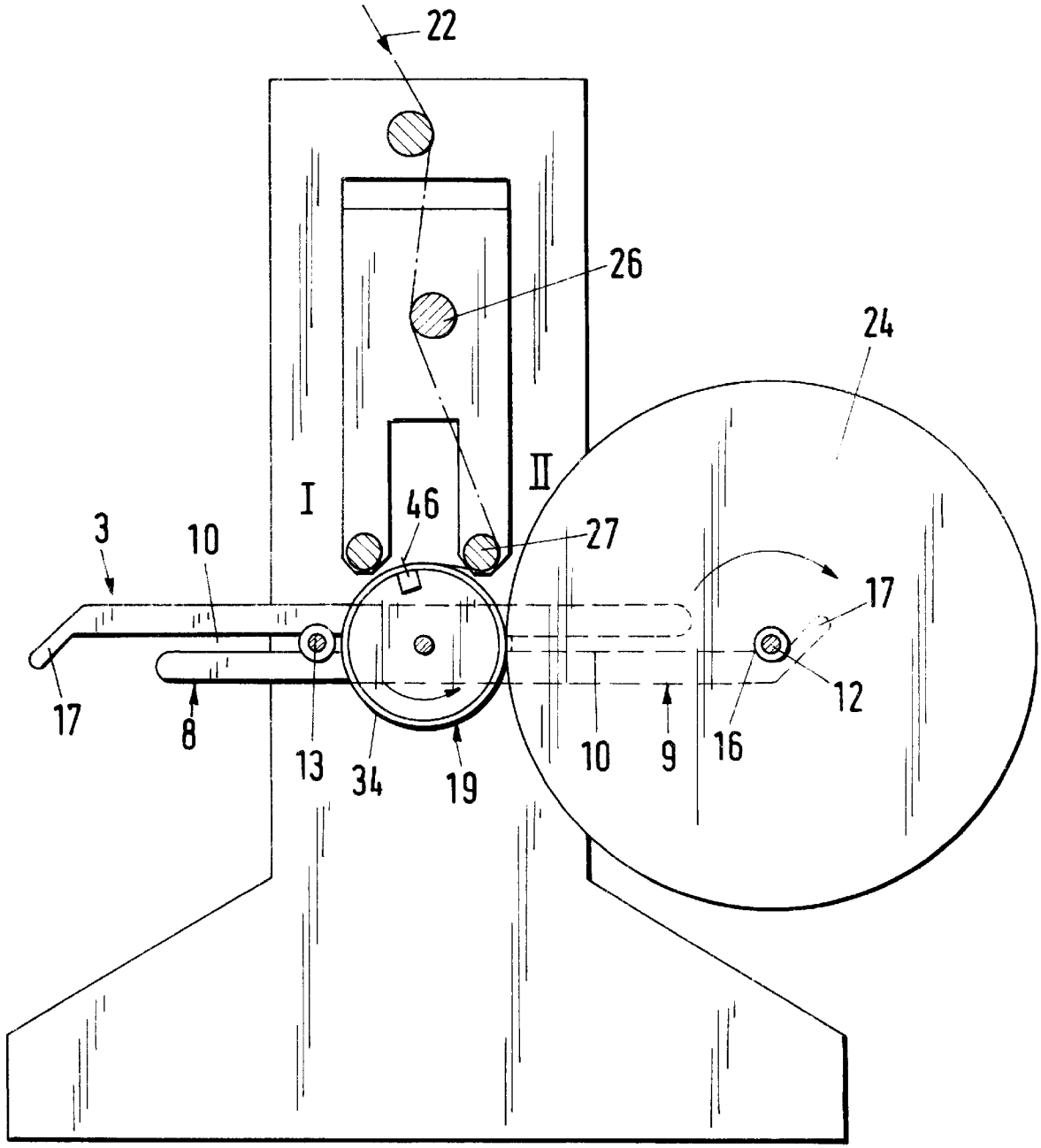
FIG. 2 shows a representation similar to that of FIG. 1, the winding of the winding roller being completed in the finished winding station and the start of the winding in the winding-start station pending shortly.
Figure 3:
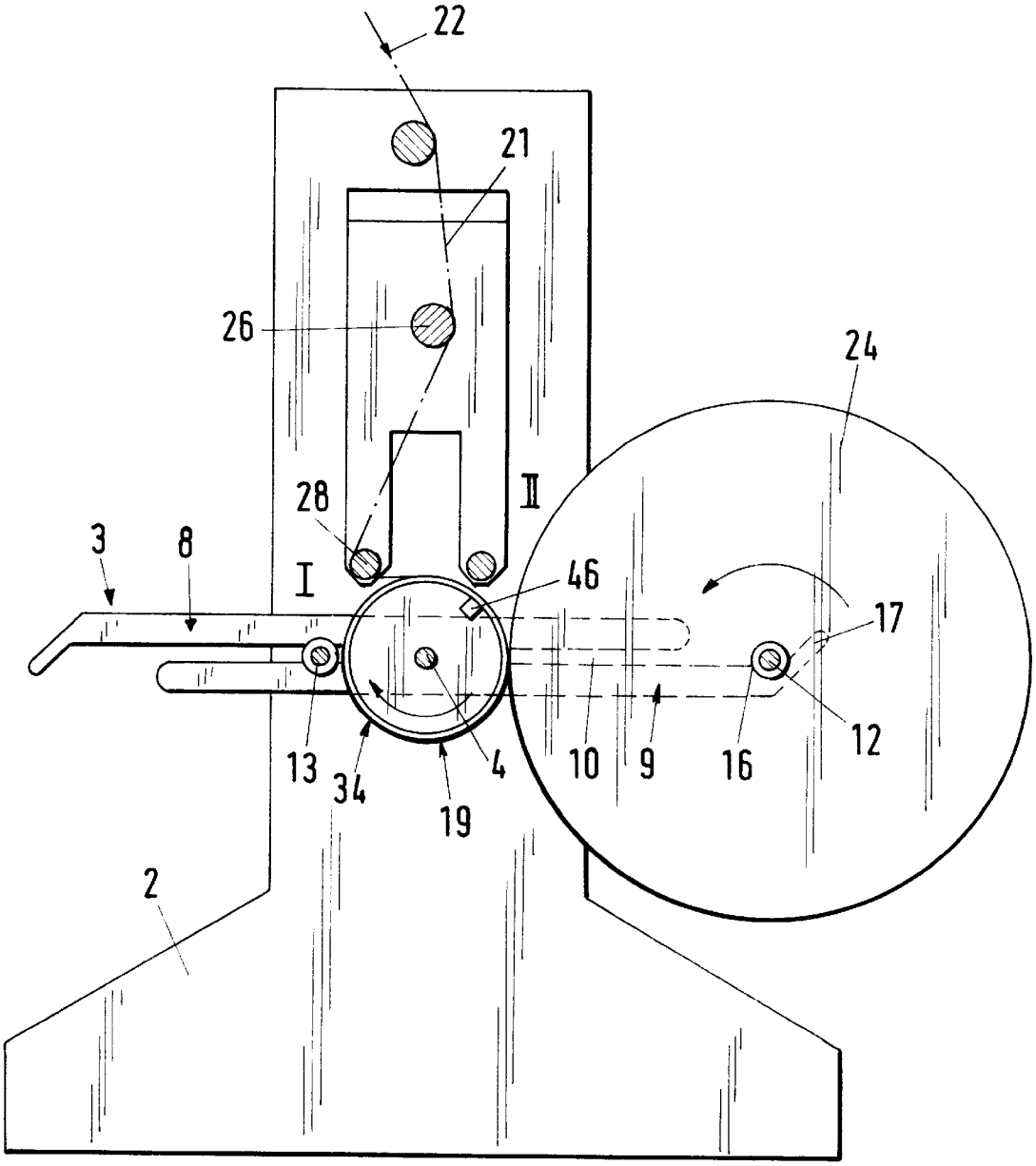
FIG. 3 shows a representation similar to that of FIG. 2, with a counterclockwise direction of winding.

Each lever arm 8, 9 is divided by its guide slot 10 into two parallel arm parts 14 and 15, of which arm part 14 is extended towards the outside over arm part 15. In its outer extended region, each arm part 14 forms an end receptacle 16 with a contact shoulder 17 for the respective winding shaft 12, carrying a winding roller 24, the winding up of which is completed (FIGS. 2 and 3). The two lever arms 8 and 9 of each individual lever 5 and 6 respectively are constructed similarly. However, in a horizontal position of the drag bearing 3, as can be seen from FIGS. 1 to 3, their arm parts 14 and 15 are alternately offset above and below the horizontal transverse plane 18 of the apparatus containing the axis of rotation 4 of the drag bearing 3.

Like the winding shafts 12 and 13, a slitting and transporting roller 19 is supported as a mating roller in the drag bearing 3 so that it can rotate about a horizontal axis of rotation 20, which coincides with the axis of rotation 4 of the drag bearing 3. In the example shown, the mating roller acts as a contact roller in concert with the winding shafts 12 and 13 and the sheet material wound on these, which is illustrated by a line of dots and dashes at 21 and is supplied in the direction of the arrows 22 to the mating roller 19. The arrangement is such that the axis of rotation 4 of the drag bearing 3 and the axis of rotation 20 of the mating roller 19, coinciding with the former axis of rotation 4, are placed in a vertical plane of osculation 23, which divides the apparatus into two working stations I and II. The two working stations I and II are defined by the horizontal position of the drag bearing 3, in which the axes of rotation of the winding shafts 12, 13 and the axis of rotation 20 of the mating roller 19 are disposed in the common transverse plane 18 of the apparatus, which furthermore contains the axis of rotation 4 of the drag bearing 3.

The mating roller 19 is connected with a driving mechanism, the direction of rotation of which can be reversed for alternately revolving in the clockwise or counterclockwise direction. Likewise the winding shafts 12 and 13 on either side of the mating roller 19 in the two working stations I and II, to which in each case half the mating roller 19 is assigned, are each connected with their own driving mechanism with a reversible direction of rotations for rotating counter to the direction of rotation of the mating roller 19. The purpose of this measure is to be able to wind up the sheet of material 21 alternately in the clockwise or counterclockwise direction on the respective winding shaft 12. The driving mechanisms with the reversible direction of rotation, which are used in this connection, are known to those skilled in the art and are therefore not shown in greater detail here.

The sheet of material 21 is supplied to the winder over guiding rollers, of which only those close to the apparatus are shown in the drawing, namely two upper guiding rollers 25 and 26 and two lower deflection rollers 27 and 28 adjoining the mating roller 19. The upper guiding roller 25 is mounted freely rotatably in the side walls 2 of the apparatus frame 1 in the vicinity of the vertical plane of osculation 23 of the apparatus, while the guiding roller 26 and the deflection rollers 27 and 28 are mounted freely rotatably in a separate extension arm 29 in the interior of the apparatus frame 1.

Depending on whether the sheet material 21 is wound on the respective winding shaft 12 in the clockwise or counterclockwise direction, either the first deflection roller 27 or the second deflection roller 28 participates in the winding process; the other deflection roller can be brought into a position of rest, which is displaced in the direction pointing away from the mating roller 19 out of the common horizontal plane of the deflection rollers 27, 28. This can be accomplished, for example, in a manner, the details of which are not shown, by shifting the respective deflection roller 27, 28 upwards in its bearing leg 32 and appropriately fastening it by reversible means.

As roller exchanging device, the mating roller 19 contains a separating slitter for severing the sheet of material 21 when the winding roller 24 is fully wound up and it encloses a pressure chamber for holding fast the new starting end of the sheet and for transferring it to a new winding shaft, such as winding shaft 13. To hold fast the new starting end of the sheet, a vacuum can be applied by means of the effective pressure chamber to the periphery 34 of the mating roller 19, so that the starting end of the sheet is suctioned to the periphery 34 of the mating roller 19. This ensures a positionally accurate further transport of the new starting end of the sheet by means of the mating roller 19. For transferring the starting end of the sheet to the new winding shaft, such as the winding shaft 13, the effective pressure chamber is switched over to pressure, as a result of which the suction effect is canceled and the starting end of the sheet is instead repelled from the periphery 34 of the roller, in order to commence the winding up on the new winding shaft 13 or on a winding tube, which is pushed onto this winding shaft 13 and which can optionally be provided in a known manner with an external application of glue.

To exercise these functions as a mating roller, the slitting and transporting roller 19, as is described in greater detail in the various embodiments of FIGS. 4 to 7, is provided with a hollow, cylindrical mantle sleeve 35, which defines the periphery of the roller 34 and is closed at both of its front ends by a face wall 36 and 37, in order to form an interior roller cavity. In the example shown, the roller sleeve 35 comprises a metal sleeve 38, onto which a caoutchouc or rubber sleeve 39 is pulled. Depending on the particular case and on the sheet material, which is to be handled by the roller 19, the metal sleeve 38 can be coated with a material other than rubber or the metal sleeve 38 can be chrome plated on the outside.

In the interior of the roller cavity, a separator 40 is provided which, together with the roller periphery 34, forms two pressure chambers 41 and 42, which extend essentially over the whole axial length of the roller. By way of an arrangement of boreholes 43 and 44 penetrating through the roller sleeve 35, the two pressure chambers 41 and 42 are connected with the surroundings. Several axial rows of penetrating boreholes 43 and 44 are provided in the example shown.

Outside of the region of the penetrating boreholes 43 and 44, the roller sheath 35 is furthermore provided with a penetrating slot 45, which in turn extends essentially over the whole of the axial length of the roller. A separating slitter 46 extends through the penetrating slot 45 and, in turn, is braced in the inner roller cavity and, moreover, also at the separator 40 in the case of the example shown.

Figure 5:
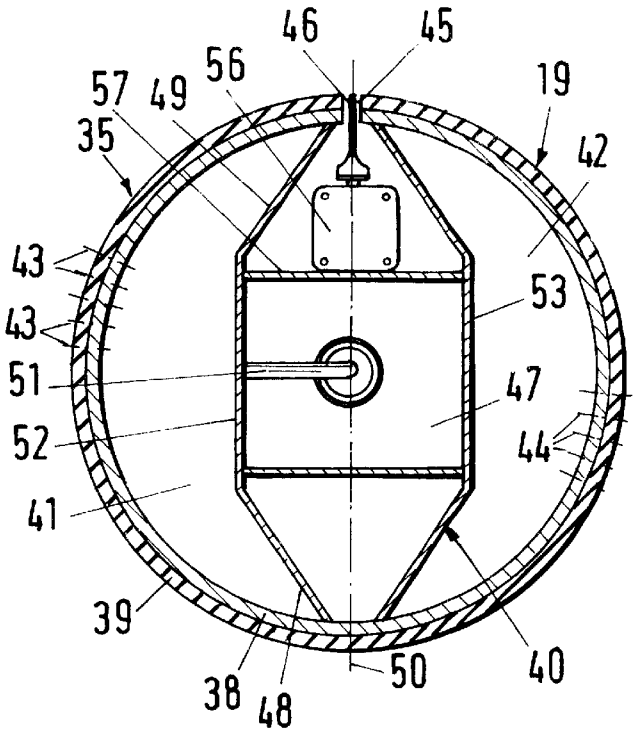
FIG. 5 shows a transverse section through the roller of FIG. 4.
Figure 4:
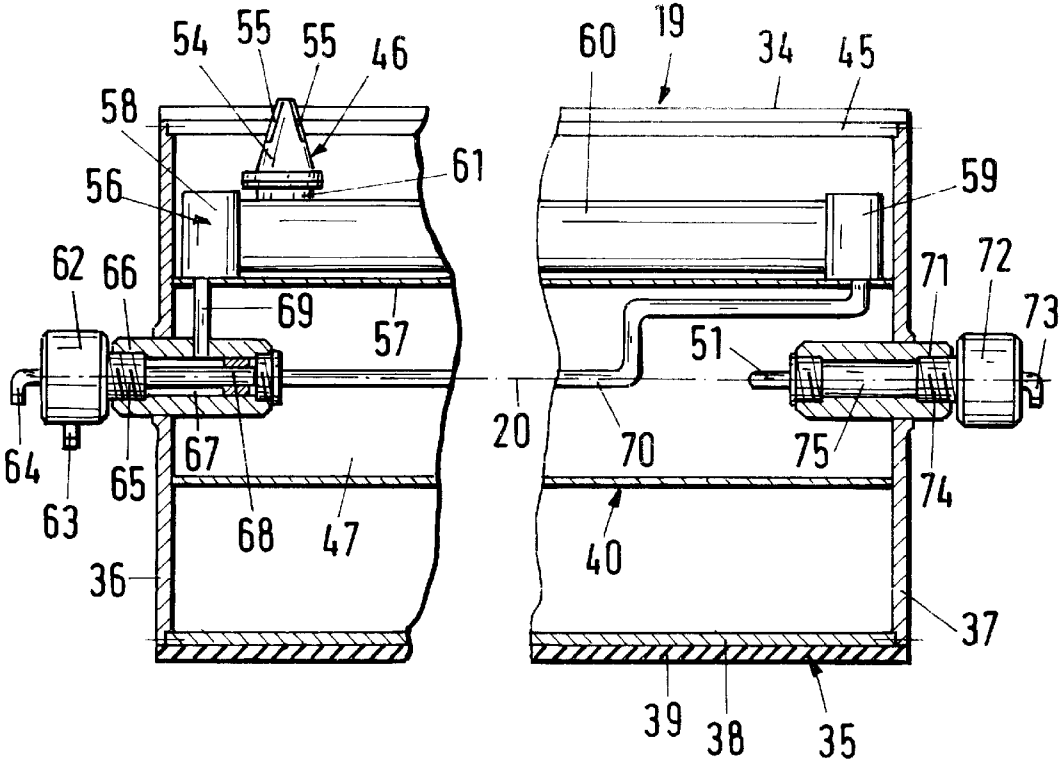
FIG. 4 shows a longitudinal section through an inventive slitting and transporting roller according to a first embodiment.

As is shown particularly by FIGS. 4 and 5, the separator 40 is constructed as a hollow profile body with a multi-chamber profile, wherein a central chamber, accommodating the roller axis 20, forms a supply chamber 47, over which a pressure medium is supplied by an external pressure medium source and fed alternately into the pressure space 41 or 42. The separating slitter 46 is braced in the region between the supply chamber 47 and the penetrating slot 45.

Figure 6:
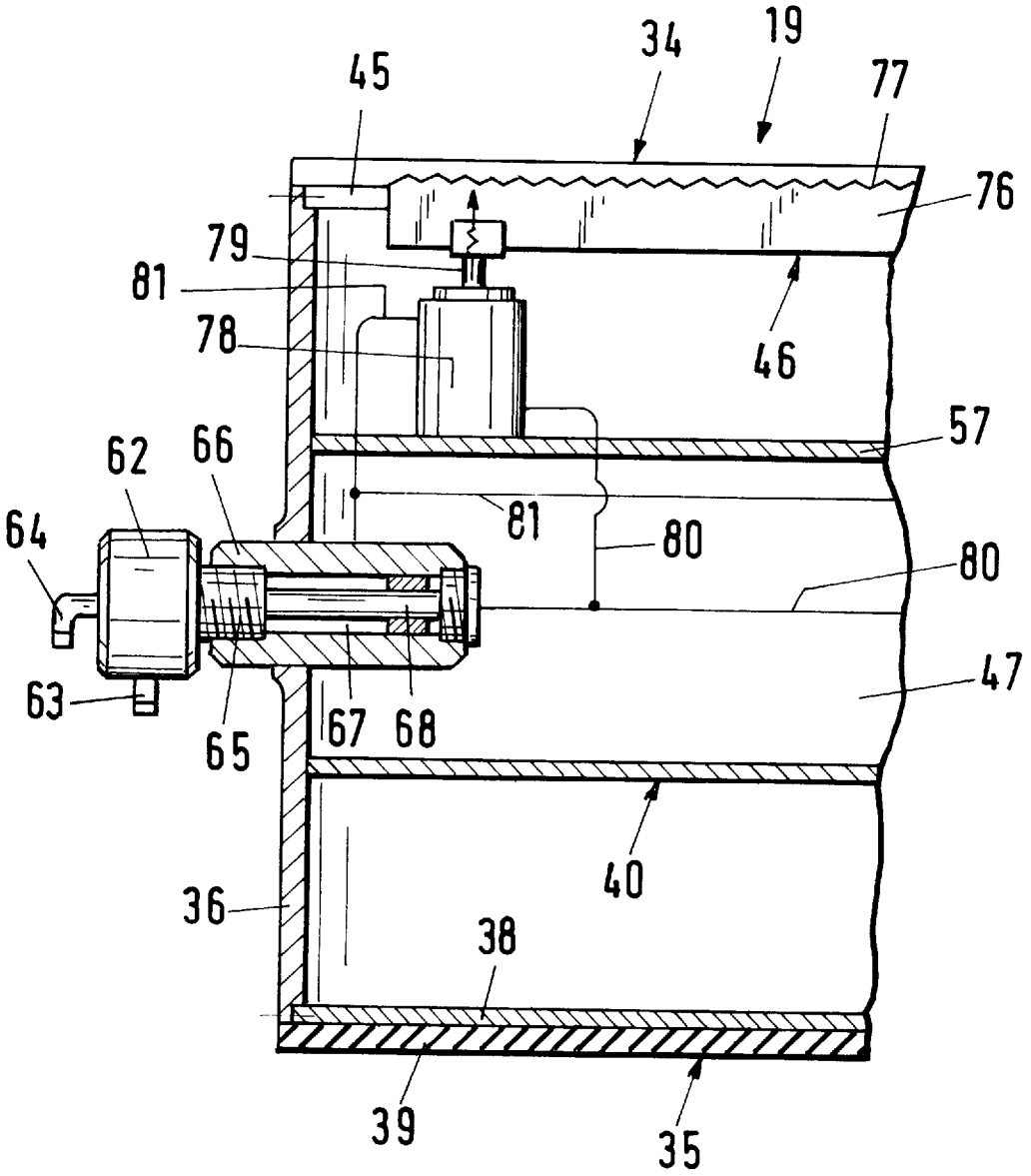
FIG. 6 shows a longitudinal section through the slitting and transporting roller of a further embodiment, limited to the region of one front face of the roller.

The separator 40 has the 3-chamber, cross sectional profile, which can be seen particularly in FIG. 6 and has a central, box-shaped part surrounding the supply chamber 47 and two outer parts 48 and 49, which taper trapezoidally to the roller sheath 35. The separator 40 extends diametrically on both sides of a diametrical plane 50 through the inner roller cavity containing the separating slitter 46 and its penetrating slot 45 and is firmly connected, for example by welding, at its radial ends with its outer parts 48 and 49 in each case with the inner sheath 38 of the roller 19 as well as with its front ends with the inner sides of the face walls 36 and 37 of the roller 19.

The separator 40 is constructed symmetrically on either side of the diametrical plane 50, so that the two pressure spaces 41 and 42 in turn are constructed correspondingly symmetrically, their penetrating boreholes 43 and 44 being disposed so as to lie diametrically opposite to one another in the roller sheath 35. However, the pattern and the arrangement of the penetrating boreholes 43 and 44 can be changed, depending on the respective application case, from the example shown diagrammatically in FIG. 5. The pressure spaces 41 and 42, which are connected with the surroundings only over the penetrating boreholes 43 and 44, but otherwise are sealed, can be connected alternatively with the external source of pressure medium.

In the case of the example shown in FIGS. 4 and 5, a feed line 51 is connected to the wall 52 of the supply chamber 47 facing the pressure space 41. The pressure space 41 is connected with the pressure medium through an appropriate opening in the wall 52, while the other pressure space 42 is closed off from the pressure medium. On the other hand, if the pressure space 42 is to be connected with the pressure medium, the feed line 51 is disconnected from the wall 52, swiveled through an angle of 180° and placed against and connected with the wall 53, which is opposite wall 52. The pressure space 42 is then connected with the pressure medium over an appropriate opening in the wall 53, while the pressure space 41 does not receive any pressure medium, that is, is not exposed to a vacuum or a pressure.

In the case of the embodiment illustrated in FIGS. 4 and 5, the separating slitter 46 is formed by a narrow, upright cutting blade 54, which protrudes through the penetrating slot 45 with a free cutting-edge region, so that it protrudes slightly beyond the roller sheath 35, that is, beyond the outer periphery 34 of the roller 19. The cutting blade 54 can be moved linearly along the penetrating slot 45 at high speed from one front face to the other of the roller 19 in order to make the severing cut through the sheet material 21. In the longitudinal direction of the penetrating slot 45, the cutting blade 54 has mutually opposite cutting edges 55 and a severing cut through the sheet material 21 can be carried out during each motion of the cutting blade 54 from front face to front face of the roller 19 with the respectively leading cutting edge 55.

The linear motion of the cutting blade 54 along the penetrating slot 45 is brought about by a pressure medium driving mechanism, which is formed by a double-acting pressure medium-operated working cylinder 56. Preferably compressed air comes into consideration as pressure medium for operating the working cylinder 56. The cylinder 56 is braced with its two terminal connecting parts 58 and 59 in the outer part 49 of the three-chamber separator 40 on an inner wall 57. A connecting pipe 60 extends between the two connecting parts 58 and 59. The cutting blade 54 is braced by a piston without piston rod (not shown) and connected with this over a narrow cross member 61, which is guided with little clearance in a guiding slot of the connecting pipe 60 of the working cylinder 56 opposite the penetrating slot 45 in the roller sheath 35. The working cylinder 56 extends essentially over the whole axial length of the roller 19, a nesting, circular or polygonal profile, for example, the rectangular profile shown in FIG. 5, being provided for the connecting pipe 60 and the piston guided in this pipe.

Compressed air is supplied to the working cylinder 56 over a known rotating inlet 62 with two inlet ducts, which are connected over external connections 63 and 64 with a compressed air feed line. The rotating inlet 62 is tightly screwed over a threaded stem 65 to a bearing stud 66 of the roller 19. In the interior of the bearing stud 66, there are two concentric ducts 67 and 68, which are connected with the two compressed air ducts of the rotating inlet 62. A pipeline 69 leads from duct 67 to the connecting part 58 of the working cylinder 56, while a pipeline 70 leads from duct 68 to the connecting part 59 of the working cylinder 56.

The knife blade 54, connected with the cylinder piston, is shown in FIG. 4 in one of its two end positions near the face wall 36, in which the cylinder piston is adjacent to the connecting part 58. For carrying out a cutting process, air compressed to a high pressure is supplied over pipeline 69 to the connecting part 58, so that the cutting blade 54 moves all of a sudden along the penetrating slot 45 to the face wall 37 of the roller 19 and, without acting in concert with a counterknife, produces an essentially rectangular severing cut through the sheet material 21. The final position of the knife blade 54 near the face wall 37 corresponds to the position near the face wall 36 shown in FIG. 4, that is, the cylinder piston with the knife blade 54 is just in front of the connecting part 59, so that, when acted upon by the pressure of the connecting line 70 and, with that, of the connecting part 59, it is driven once again all of a sudden in the opposite direction along the penetrating slot 45 to carry out a severing cut through the sheet material 21.

Moreover, the bearing stud 66, just as a further bearing stud 71 in the face wall 37, serves in a known manner for driving the shaft 19. For this purpose, the bearing stud 71 is also provided with a rotating inlet, which is labeled 72 here. In contrast to the rotating inlet 62, rotating inlet 72 has only one central pressure-medium duct, which is connected over an external connection 73 with a pressure medium feed line. The central pressure medium duct is connected over a hollow threaded stem 74 with an inner pressure medium duct 75 of the bearing stud 71, from the inner end of which the pressure medium pipeline 51 originates for supplying the pressure space 41 or 42 with air as pressure medium. The pressure medium duct 75 can be connected over rotating inlet 72 alternately with an external source of vacuum or of pressure through an appropriate switching-over process in the supplying system.

The connection with an external source of vacuum means that air is aspirated from the surroundings through penetrating boreholes 43 or 44 or that a sheet material, lying over the penetrating boreholes 43 or 44, is aspirated in this region against the roller periphery 34. Upon switching over from the source of vacuum to the source of pressure, compressed air is supplied to the pressure medium duct 75 and, with that, over pipeline 51 to the pressure space 41 or 42 at such a pressure, that the sheet material, previously held fast in the region of the penetrating boreholes 43 or 44, is repelled from the roller periphery 34 by compressed air acting on the penetrating boreholes 43 and 44 in order, in the course of the exchange of rollers for the case described above, to be fixed on the winding tube of a new winding shaft 13.

For the embodiment of a slitting and transporting roller 19 of FIG. 6, which can be used as a mating roller for a winder, as well as in the case of the further embodiment of FIG. 7, which will be still be described below, components, which are similar to or identical with those of the embodiment of FIGS. 4 and 5, will be provided with the same reference numbers without a further description.

In the case of the embodiment of FIG. 6, the separating slitter 46 is formed by a cutting blade 76 with an external cutting edge 77, the length of which is essentially the same as that of the penetrating slot 45. The cutting edge 77, which is serrated, is normally held, as shown in FIG. 6, within the penetrating slot 45 without protruding beyond the roller periphery 34. For carrying out a severing cut through the sheet material 21 transversely to the running direction, the cutting blade 76 is moved briefly at high speed in the radial direction of the roller diameter out of and back into the penetrating slot 45.

For this purpose, double-acting, pressure medium-operated hydraulic cylinders 78, preferably compressed air cylinders, which are contiguous with the respective roller face wall 36 or 37, are provided in the two end regions of the cutting blade 76. The hydraulic cylinders 78 are supported in each case on the inner wall 57 of the separator 40. The piston rod 79 of the respective of the respective hydraulic cylinder 78 is fastened to the inside of the cutting blade 76. For the forward and reverse stroke of the piston of the hydraulic cylinder 78, pressure medium feed lines 80 and 81 are provided in a known manner so as to discharge on both sides of the front ends of the piston. The pipelines 80 and 81, as well as the other bearing stud, which is not shown and are supplied over a rotating inlet 62 and a bearing stud 66, as shown in FIG. 4. The other bearing stud 71, which is not shown in FIG. 6, corresponds to the bearing stud 71 of FIG. 4.

If thermoplastic films are processed exclusively, the cutting blade 76 can also be replaced by a heatable resistance wire with an appropriate holder and otherwise identical mode of operation, as explained by means of FIG. 6, for carrying out a melting cut.

Figure 7:
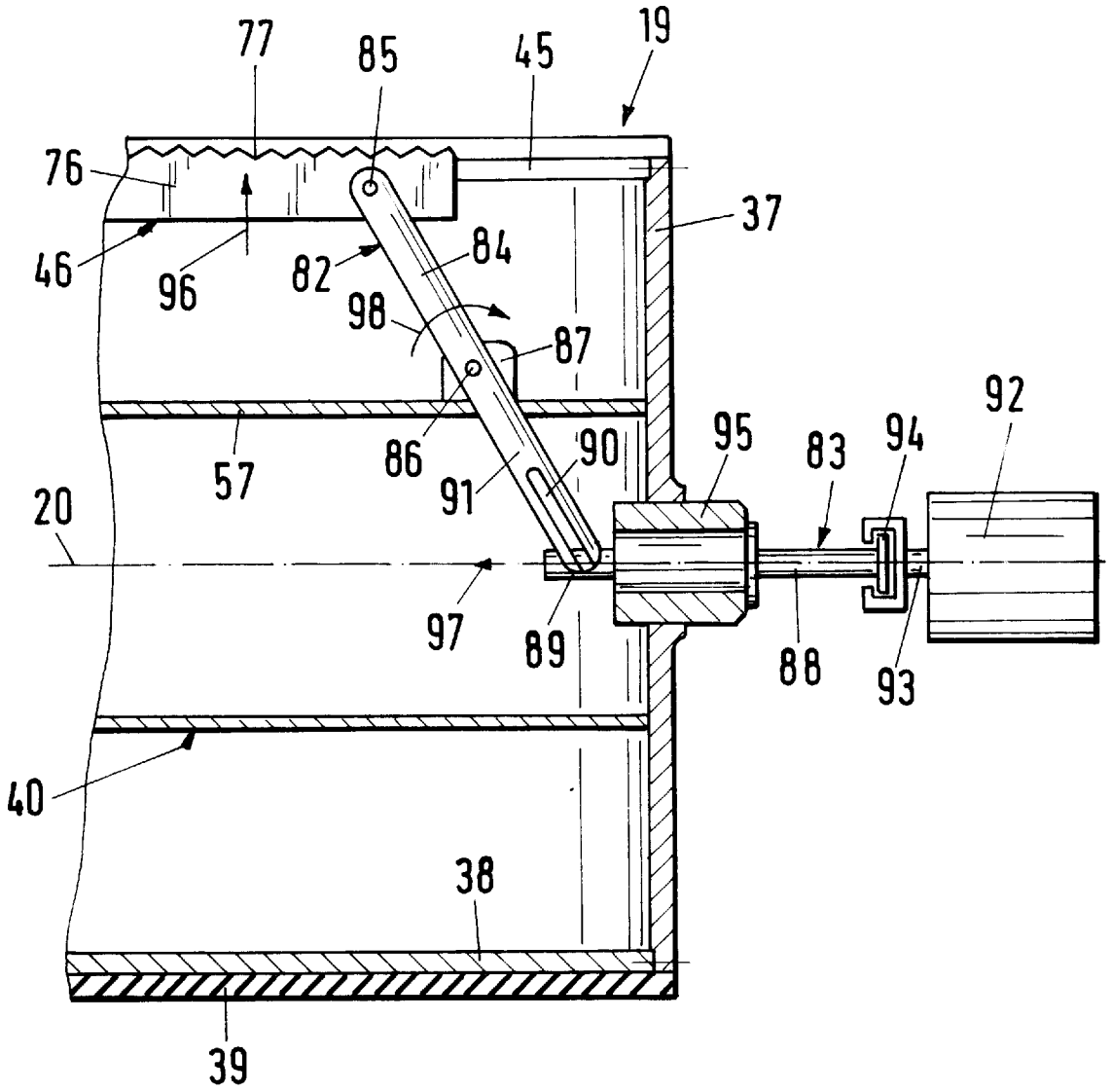
FIG. 7 shows a longitudinal section through a further embodiment of the slitting and transporting roller, once again limited to the region of a front face of a roller.

For the embodiment of FIG. 7, the separating slitter 46, which can once again be constructed as a serrated blade 76 with a serrated cutting edge 78, can be operated over a system of parallel guiding rods 82 mounted in the interior cavity of the roller 19 by an external connecting rod driving mechanism 83, which is operated by a pressure medium.

The system of parallel guiding rods 82 comprises a guide rod 84, which is linked at 85 to the knife blade 76 and at 86 to a holder 87, which in turn is fastened to the inner wall 57 of the separator 40. The guide rod 84 is passed through the inner wall 57 and connected at its inner end with a connecting rod 88 of the connecting rod driving mechanism 83. For this purpose, the connecting rod 88 has at its inner end an engagement bolt 89, which engages an elongated hole 90 of the guide rod arm 91 on the near side of the rotating connection 86, at approximately the level of the axis of rotation 20 of the roller 19. In FIG. 7, the cutting blade 76 is shown in its inoperative position, in which it lies with its cutting edge 77 within the penetrating slot 45. At the end of the cutting blade 76 facing the face wall 36 of the roller 19, the system of parallel guiding rods 82 comprises a corresponding guide rod arrangement, with the exception of the inner guide rod arm 91, in the orientation of the guide rod 84 shown in FIG. 7.

The connecting-rod driving mechanism 83 furthermore comprises a pressure medium-operated working cylinder 92, which preferably is a pneumatic, hydraulic cylinder, the piston rod 93 of which is firmly connected with the connecting rod 88 by means of a coupling 94. The connecting rod 88 is passed through the bearing stud 95 at the front face of the roller 19, which is constructed for this purpose simultaneously as a guide bushing. The other bearing stud, which is not shown in FIG. 7, is constructed similarly to the bearing stud 71 of FIG. 4.

For a brief excursion of the separating slitter 46 in the direction of the arrow 96, the connecting rod 88 is moved by means of the hydraulic cylinder 92 inward in the direction of the arrow 97, the guide rods 84 swiveling about their fulcrum in correspondence with the motion arrow 98. By these means, the cutting blade 76 is moved with a combined radial and axial motion with high accuracy out of the penetrating slot 45 and back again when the hydraulic cylinder 92 is reversed. This way of moving the cutting blade 76 out of the penetrating slot results in a so-called pulling cut, which, depending on the material to be cut, may be advantageous in comparison with other embodiments of the knife 46.

In FIG. 1, the winder is shown in the running winding operation, the incoming sheet of material 21, looped around the deflection roller 27, being supplied over the mating roller 19 to the winding roller 24, which is rotating in the clockwise direction. A new winding shaft 13 has already been inserted in work station I.

FIG. 2 shows the winding roller 24, fully wound up in the clockwise direction, shortly before a new end of the sheet is wound onto the winding shaft 13 in the work station I. The exchange of the rollers is initiated by giving a control signal when the winding roller 24 has reached a certain diameter. When the winding up is in the clockwise direction, the signal causes a vacuum to be developed in the pressure room 42 by means of the external vacuum source, so that the incoming sheet material 21 is aspirated at the periphery 34 of the mating roller 19 through the penetrating openings 44 in the roller sheath 35. The cutting process is carried out by means of the separating slitter 46 by appropriately controlling the driving mechanism, while the sheet of material 21 is being supplied continuously between the deflection roller 27 and the new winding shaft 13. For this, the deflection roller 28 is in its inoperative position.

The end of the sheet, severed all of a sudden by means of the separating slitter 46, continues to be pressed, because of the existing vacuum, over the penetrating boreholes 44 of the pressure chamber 42 against the periphery 34 of the roller and, by these means, transported further by said roller until the new winding shaft 13, which has now been caused to rotate, is reached. As soon as the severed end of the sheet has reached the contact line between the mating roller 19 and the winding tube pushed onto the winding shaft 13, a reversal is made in such a manner, that the pressure space 42 is connected with the external source of pressure, so that the pressure space 42 is acted upon with pressure above atmospheric or compressed air. As a result, the end of the sheet of material 21 is detached from the mating roller 19 and is transferred as a new start to the winding tube of the new winding shaft 13, which has been equipped, for example, with an adhesive strip.

Aside from the directions of rotation and corresponding to the supplying of the sheet of material 21 over the deflection roller 28, FIG. 3 illustrates an instantaneous state of the winding process corresponding to that of FIG. 2. In principle, rollers are exchanged in the same way here as described by means of FIG. 2. However, the suction action is applied over the penetrating boreholes 43 of the pressure space 41 corresponding to the direction of rotation of the mating roller 19 at the periphery 34 of the latter and the transverse severing by means of the knife 46 takes place between the deflection roller 28 and the contact line between the mating roller 19 and the winding roller 24. The severed, aspirated end of the sheet is then transported further in the manner described and transferred to the new winding shaft 13. The processes, explained in connection with FIG. 2, then follow.

During the removal of the winding roller 24 from the work station II, there is sufficient time to remove a new winding shaft 13 from a winding shaft magazine, provide it with a winding tube, usually of cardboard with an external adhesive strip, and bring it into position in work station I, in order to cause it to rotate in the specified direction in good time for carrying out the winding process. The winding shafts 12 and 13 can be locked in their respective guiding slots 10 of the drag bearing 3 with suitable means, which are readily available to the expert in this field, such as a claw device.

Rollers are exchanged easily, rapidly and without problems since the sheet of material 21 is severed transversely with the inventive slitting and transporting roller as mating roller 19 without interrupting the flow of the sheet 21 with a minimum expenditure of time and the new end of the sheet can be transported reliably to the new winding shaft 13.

It is self-evident that the inventive slitting and transporting roller 19 is suitable not only as a mating roller with a roller-exchanging mechanism in an apparatus for winding up films, sheets of paper and similar materials of the type described above coming in continuously, but also in other applications for fulfilling similar or the same tasks and especially also for use in other winders, in particular, those which do not work with a drag bearing forming an initial winding station and a final winding station and for which only one winding station is provided, which serves for the initial and final winding of the respective roll of material.

I claim:

1. A slitting and transporting apparatus for sheet material comprising:

a roller means having an inner cavity;

a separator means within said cavity, said separator means together with said roller means deferring a chamber in said cavity extending substantially the longitudinal length of said roller means;

said roller means having openings which open up to the ambient and which communicate with said chamber;

said roller means further having an elongated slitter slot extending substantially the longitudinal length of said roller means; and slitter means operable in said cavity and in said slitter slot for slitting said sheet material on said roller means;

said roller means further comprising a cylindrical member, said separator means together with said cylindrical member defining two of said chambers disposed on either side of said separator means, said openings which open up to the ambient communicating with each of said two chambers, said roller means further comprising medium means operable to provide a medium from a medium source to either of said two chambers;

said openings which communicate with one of said chambers being generally diametrically opposite to said openings which communicate with said other chamber.

2. A slitting and transporting apparatus for sheet material comprising:

a roller means having an inner cavity;

a separator means within said cavity, said separator means together with said roller means deferring a chamber in said cavity extending substantially the longitudinal length of said roller means;

said roller means having openings which open up to the ambient and which communicate with said chamber;

said roller means further having an elongated slitter slot extending substantially the longitudinal length of said roller means; and slitter means operable in said cavity and in said slitter slot for slitting said sheet material on said roller means;

said roller means further comprising a cylindrical member, said separator means together with said cylindrical member defining two of said chambers disposed on either side of said separator means, said openings which open up to the ambient communicating with each of said two chambers, said roller means further comprising medium means operable to provide a medium from a medium source to either of said two chambers;

said separator means defining an interior enclosure disposed between said two chambers, said interior enclosure being supplied with said medium from said medium source, said medium means comprising a conduit means having one operable position for conducting said medium between said interior enclosure and one of said chambers and another operable position for conducting said medium between said interior enclosure and the other of said chambers, said conduit means being in said one operable position when said roller means rotates in one direction, said conduit means being in said other operable position when said roller means rotates in an opposite direction.

3. A slitting and transporting apparatus for sheet material comprising:

a roller means having an inner cavity;

a separator means within said cavity, said separator means together with said roller means deferring a chamber in said cavity extending substantially the longitudinal length of said roller means;

said roller means having openings which open up to the ambient and which communicate with said chamber;

said roller means further having an elongated slitter slot extending substantially the longitudinal length of said roller means; and slitter means operable in said cavity and in said slitter slot for slitting said sheet material on said roller means;

said roller means comprising a cylindrical member, said separator means together with said cylindrical member defining two of said chambers disposed on either side of said separator means, said openings which open up to the ambient communicating with each of said two chambers, said roller means further comprising medium means operable to provide a medium from a medium source to either of said two chambers;

said medium means having one operating mode in which said medium at a pressure less than atmospheric is provided to one of said chambers and another operating mode in which a medium at a pressure greater than atmospheric is provided to said one chamber, said roller means having a rotated cutting position in which said sheet material is disposed over said openings which communicate with said one chamber, said medium means being in said one operating mode when said rotating means is in said rotated cutting position such that the sheet material is adhered to said roller means by the medium at a pressure less than atmospheric acting on said sheet material via said openings which communicate with said one chamber, said slitter means being operable to slit said sheet material while said medium means is in said one operable mode such that during slitting and subsequent to slitting, the two cut end portions of the sheet material which result from the slitting continue to be adhered to said roller means by the medium at a pressure less than atmospheric acting on said two cut end portions via said openings which communicate with said one chamber, said rotatable means, after said slitting, being rotatable advanced in one direction from said one rotated cutting position to a transfer position in which one of said two cut end portions of said sheet material is transferred onto a start-up roller to be wound with said sheet material in a first rotatable direction, said medium means changing over to said second operating mode when said roller means is in said transfer position such that said one cut end portion is displaced from said roller means onto said start-up roller by the medium at a pressure higher than atmospheric acting on said one cut end portion via said openings which communicate with said one chamber.

4. A slitting and transporting apparatus for sheet material according to claim 3 wherein said medium means has a third operating mode in which said medium at a pressure less than atmospheric is provided to the other of said two chambers and a fourth operating mode in which a medium at a pressure greater than atmospheric is provided to said other of said two chambers, said roller means having another rotated cutting position in which said sheet material is disposed over said openings which communicate with said other chamber, said medium means being in said third operating mode when said rotating means is in said other rotated cutting position such that the sheet material is adhered to said roller means by the medium at a pressure less than atmospheric acting on said sheet material via said openings which communicate with said other chamber, said slitter means being operable to slit said sheet material while said medium means is in said third operable mode such that during slitting and subsequent to slitting, the two cut end sections of the sheet material which result from the last said slitting continue to be adhered to said roller means by the medium at a pressure less than atmospheric acting on said two cut end sections via said openings which communicate with said other chamber, said rotatable means, after the last said slitting, being rotatable advanced in a direction opposite to said one direction from said other rotated cutting position to another transfer position in which one of said two cut end sections of said sheet material is transferred onto a start-up winding shaft to be wound with said sheet material in a second rotatable direction opposite said first rotatable direction, said medium means changing over to said fourth operating mode when said roller means is in said other transfer position such that said one cut end section is displaced from said roller means onto said start-up winding shaft by the medium at a pressure higher than atmospheric acting on said one cut end section via said openings which communicate with said other chamber.

5. A slitting and transporting apparatus for sheet material comprising:

a roller means having an inner cavity;

a separator means within said cavity, said separator means together with said roller means deferring a chamber in said cavity extending substantially the longitudinal length of said roller means;

said roller means having openings which open up to the ambient and which communicate with said chamber;

said roller means further having an elongated slitter slot extending substantially the longitudinal length of said roller means; and slitter means operable in said cavity and in said slitter slot for slitting said sheet material on said roller means;

said slitter means comprising a cutting table blade having two opposed cutting edges, and drive means operable to move said blade linearly along said slitter slot in one direction so that one of said cutting edges cuts said sheet material, said drive means being operable to move said blade linearly along said slitter slot in an opposite direction so that the other of said cutting edges cuts said sheet material.

6. A slitting and transporting apparatus for sheet material comprising:

a roller means having an inner cavity;

a separator means within said cavity, said separator means together with said roller means deferring a chamber in said cavity extending substantially the longitudinal length of said roller means;

said roller means having openings which open up to the ambient and which communicate with said chamber;

said roller means further having an elongated slitter slot extending substantially the longitudinal length of said roller means; and slitter means operable in said cavity and in said slitter slot for slitting said sheet material on said roller means;

said slitter means comprising a cutting knife and a drive means utilizing a pressure medium for moving said cutting knife along said slitter slot;

drive means comprising a cylinder and a piston operable in said cylinder, said piston driving said cutting knife, said cylinder having an axial length substantially equal to the axial length of said roller means, said roller means having longitudinal ends, said cylinder having longitudinal end portions juxtaposed to said longitudinal ends of said roller means, and pressure medium means utilizing a medium for driving said piston in said cylinder, said pressure medium means comprising conduits for said medium, said conduits being connected to said longitudinal end portions of said cylinder.

7. A slitting and transporting apparatus for sheet material according to claim 6 wherein said cylinder has an elongated guiding slot, said slitter means comprising a cross member movable in said guiding slot, said cross member being connected to said cutting knife and to said piston, said guiding slot being disposed radially inwardly of said slitter slot.

8. A slitting and transporting apparatus for sheet material comprising:

a roller means having an inner cavity;

a separator means within said cavity, said separator means together with said roller means deferring a chamber in said cavity extending substantially the longitudinal length of said roller means;

said roller means having openings which open up to the ambient and which communicate with said chamber;

said roller means further having an elongated slitter slot extending substantially the longitudinal length of said roller means; and slitter means operable in said cavity and in said slitter slot for slitting said sheet material on said roller means;

said slitter means comprising a cutting blade having a longitudinal length substantially equal to the longitudinal length of said roller means, said slitter means comprising drive means for moving said cutting blade between a disposed position and a cutting position, said cutting blade when in said disposed position being disposed within said slitter slot, said cutting blade when in said cutting position extending from said slitter slot to slit said sheet material.

9. A slitting and transporting apparatus for sheet material according to claim 8 wherein said cutting blade has a serrated cutting edge.

10. A slitting and transporting apparatus for sheet material comprising:

a roller means having an inner cavity;

a separator means within said cavity, said separator means together with said roller means deferring a chamber in said cavity extending substantially the longitudinal length of said roller means;

said roller means having openings which open up to the ambient and which communicate with said chamber;

said roller means further having an elongated slitter slot extending substantially the longitudinal length of said roller means; and slitter means operable in said cavity and in said slitter slot for slitting said sheet material on said roller means;

said slitter means comprising a heatable resistance wire means having a longitudinal length substantially equal to the longitudinal length of said slitter slot, said slitter means comprising drive means for moving said wire means between a disposed position and a severing position, said wire means when in said disposed position being disposed within said slitter slot, said wire means when in said severing position extending from said slitter slot to sever said sheet material.

11. A slitting and transporting apparatus for sheet material comprising:

a roller means having an inner cavity;

a separator means within said cavity, said separator means together with said roller means deferring a chamber in said cavity extending substantially the longitudinal length of said roller means;

said roller means having openings which open up to the ambient and which communicate with said chamber;

said roller means further having an elongated slitter slot extending substantially the longitudinal length of said roller means; and slitter means operable in said cavity and in said slitter slot for slitting said sheet material on said roller means;

said slitter means comprising a severing means, and drive means for moving said severing means radially outwardly and inwardly to respectively dispose said severing means outside and inside said slitter slot.

12. A slitting and transporting apparatus for sheet material according to claim 11 wherein said drive means comprises a double-acting cylinder supplied with a pressure medium, said roller means having a longitudinal end, said cylinder being disposed in said cavity juxtaposed to said longitudinal end.

13. A slitting and transporting apparatus for sheet material comprising:

a roller means having an inner cavity;

a separator means within said cavity, said separator means together with said roller means deferring a chamber in said cavity extending substantially the longitudinal length of said roller means;

said roller means having openings which open up to the ambient and which communicate with said chamber;

said roller means further having an elongated slitter slot extending substantially the longitudinal length of said roller means; and slitter means operable in said cavity and in said slitter slot for slitting said sheet material on said roller means;

said slitter means comprising a severing means and drive means comprising a cylinder utilizing a pressure medium for driving said severing means to effect severing of said sheet material, said roller means comprising bearing support means for rotatably supporting said roller means, said bearing support means having conduits for conducting said medium to said cylinder.

14. A slitting and transporting apparatus for sheet material comprising:

a roller means having an inner cavity;

a separator means within said cavity, said separator means together with said roller means deferring a chamber in said cavity extending substantially the longitudinal length of said roller means;

said roller means having openings which open up to the ambient and which communicate with said chamber;

said roller means further having an elongated slitter slot extending substantially the longitudinal length of said roller means; and slitter means operable in said cavity and in said slitter slot for slitting said sheet material on said roller means;

said slitter means comprising a severing means and drive means for moving said severing means between a disposed position in which said severing means is disposed in said slitter slot and a cutting position in which said severing means extends out of said slitter slot, said drive means comprising lever means pivotal in said cavity to effect a combined radial and axial motion to said severing means as said severing means is moved between said disposed position and said cutting position.

15. A slitting and transporting apparatus for sheet material according to claim 14 wherein said drive means comprises a power means for driving said lever means, said power means being located externally of said cavity.

16. A slitting and transporting apparatus for sheet material comprising:

a roller means having an inner cavity;

a separator means within said cavity, said separator means together with said roller means deferring a chamber in said cavity extending substantially the longitudinal length of said roller means;

said roller means having openings which open up to the ambient and which communicate with said chamber;

said roller means further having an elongated slitter slot extending substantially the longitudinal length of said roller means; and slitter means operable in said cavity and in said slitter slot for slitting said sheet material on said roller means;

said chamber and said openings being adapted to operate with a medium with said medium being supplied from a medium source, said roller means having bearing support means for rotatably supporting said roller means, said bearing support means having conduits operable to effect passage of said medium between said medium source and said chamber such that the pressure of said medium in said chamber and said openings will adhere said sheet material or displace said sheet material relative to said roller means depending on whether the pressure of said medium in said chamber is below or above atmospheric.

17. A slitting and transporting apparatus for sheet material comprising:

a roller means having an inner cavity;

a separator means within said cavity, said separator means together with said roller means deferring a chamber in said cavity extending substantially the longitudinal length of said roller means;

said roller means having openings which open up to the ambient and which communicate with said chamber;

said roller means further having an elongated slitter slot extending substantially the longitudinal length of said roller means; and slitter means operable in said cavity and in said slitter slot for slitting said sheet material on said roller means;

roller means comprising operable means having one operable condition wherein a pressure below atmospheric is applied to said openings to thereby effect adherence of said sheet material to said roller means, said operable means having another operable condition wherein a pressure above atmospheric is applied to said openings to effect displacement of said sheet material from said roller means.

* * * * *